US006506545B1

(12) United States Patent
Bulliard et al.

(10) Patent No.: US 6,506,545 B1
(45) Date of Patent: Jan. 14, 2003

(54) PROCESS FOR THE REMOVING STAIN IN A PHOTOGRAPHIC MATERIAL

(75) Inventors: Christophe Bulliard, Basel (CH); Georges Metzger, Moernach (FR); Sonia Megert, Ueken (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/936,371

(22) PCT Filed: Mar. 2, 2000

(86) PCT No.: PCT/EP00/01807

§ 371 (c)(1),
(2), (4) Date: Sep. 13, 2001

(87) PCT Pub. No.: WO00/55688

PCT Pub. Date: Sep. 21, 2000

(30) Foreign Application Priority Data

Mar. 15, 1999 (EP) ..... 99810230

(51) Int. Cl.[7] ..... G03C 5/56; G03C 7/392
(52) U.S. Cl. ..... 430/429; 430/372; 430/614
(58) Field of Search ..... 430/372, 429, 430/614

(56) References Cited

U.S. PATENT DOCUMENTS

| | | | | |
|---|---|---|---|---|
| 4,587,195 | A | 5/1986 | Ishikawa et al. | 430/139 |
| 6,210,449 | B1 | 4/2001 | Rohringer et al. | 8/648 |

FOREIGN PATENT DOCUMENTS

| | | | |
|---|---|---|---|
| JP | 1-158443 | * | 6/1989 |
| WO | 96/00221 | | 1/1996 |
| WO | 98/42685 | | 10/1998 |
| WO | 99/42454 | | 8/1999 |

OTHER PUBLICATIONS

Chem. Abstr. 71:126005 for NL 6714386 (1969).
Patent Abstracts of Japan Publication No. 62106965 (1987).

* cited by examiner

*Primary Examiner*—Hoa Van Le
(74) *Attorney, Agent, or Firm*—Tyler A. Stevenson

(57) ABSTRACT

A process for removing stain in a photographic material is described which process comprises incorporation of at least one compound of formula (I) wherein X is O or NH; n is 1 or 2, p is 0, 1 or 2, M is hydrogen, an alkali metal atom, ammonium or a cation formed from an amine; each $R_1$, independently, is an amimoacid residue from which a hydrogen atom on the amino group has been removed; each $R_2$, independendy, is hydrogen, $C_1$–$C_8$alkyl, $C_1$–$C_8$alkoxy, halogen, cyano, COOR, wherein R is hydrogen or $C_1$–$C_3$alky1, CONH—R in which R has its previous significance, $SO_2NH$—R in which R has its previous significance, NH—COR in which R has its previous significance, or $SO_3M$, wherein M has its previous significance, or, if n is 1, $R_2$ can also be CO—$R_3$ in which $R_3$ is $C_1$–$C_3$alkyl or phenyl, in that photographic material.

(I)

15 Claims, No Drawings

PROCESS FOR THE REMOVING STAIN IN A PHOTOGRAPHIC MATERIAL

The present invention relates to a process for removing stain in a photographic material which comprises a silver halide photographic light-sensitive material and, more detailedly, to a process thereof, wherein the improvement is made on the prevention of a colour stain and particularly the prevention of a colour dye stain caused in the course of processing said silver halide photographic light-sensitive material by a colour developer or by components of a bleach-fix bath.

In general, a colour photographic print is produced by exposing a light-sensitive material to light through a colour negative film and by applying in succession the processing steps mainly consisting of a colour development by means of a paraphenylenediamine type developing agent, a bleach-fix step, and a washing and/or stabilising step.

The essential requirements for practically making such colour prints are that the colour reproductivity and the whiteness of the unexposed areas of such colour prints, that is the so-called white-background property, should be excellent.

In recent years, a yellow, red or other coloured stain was shown to be apt to occur particularly on a silver halide colour photographic light-sensitive material when the light-sensitive material was processed in a colour developer and then in a bleach-fix bath. Various causes of these colour stains may be considered, and inter alia, a colour stain which has been known is that caused by a reaction of the oxidation products of a colour developing agent in a bleach-fix bath with couplers being contained in a light-sensitive material. Another stain which has also been known is that substances liquated out of a light-sensitive material, or that components of a bleach-fix bath or the like adhered to the light-sensitive material or permeated into an edge area—when the bleach-fix bath was concentrated in a running process.

Another well known stain is that produced by sensitizing dyes, anti-irradiation dyes or the like which are not washed properly out of the photographic material.

Accordingly, there have so far been well-known techniques with the purpose of solving the above mentioned problems, for example, a stain prevention technique disclosed in Japanese Patent Publication Open to Public Inspection (hereinafter referred to as Japanese Patent O.P.I. Publication) No. 102640/1976, in which an alkylamino compound is added to a bleach-fix bath; another stain prevention technique disclosed in Japanese Patent O.P.I. Publication No. 71639/1973, in which some kind of magenta couplers to be contained in a light-sensitive material is combined with a hardening agent; a further technique disclosed in Japanese Patent Examined Publication No. 23179/1976, in which an oxide of some kind of amino compounds is added to a bleach-fix bath; or the like.

Besides the above mentioned colour stain prevention techniques, there have also been well known methods for lessening the deterioration of a white background caused by a colour stain, in which the spectral reflectivity of such white background areas was evenly increased by the action of an optical brightening agent contained in a light-sensitive material, or by adding the same to a processing liquid, such as exemplified by U.S. Pat. Nos. 5,043,253, 4,587,195, JP-A-71 035 240, JP-A-73 085 232, JP-A-74 020 975 as well as RD 37336. Optical brightening agents to be suitably used into light-sensitive materials are mentioned additionally in RD 17643, RD 18716 and RD 307105.

However, there has been a limitation of the development of highly concentrated processing liquids due to the low solubility of such optical brightening agents in said processing liquids.

The present invention relates to a process for removing stain in a photographic material which process comprises the incorporation of at least one compound of the formula (I)

(I)

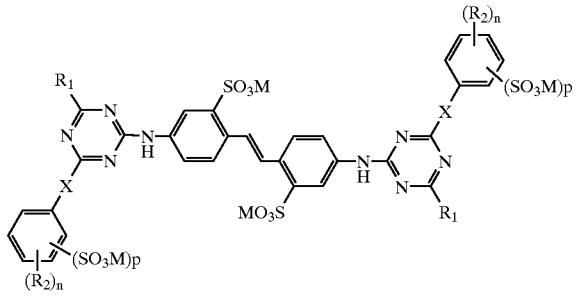

wherein

X is O or NH;

n is 1 or 2, p is 0, 1 or 2,

M is hydrogen, an alkali metal atom, ammonium or a cation formed from an amine;

each $R_1$, independently, is an aminoacid residue from which a hydrogen atom on the amino group has been removed;

each $R_2$, independently, is hydrogen, $C_1$–$C_8$alkyl, $C_1$–$C_8$alkoxy, halogen, cyano, COOR, wherein R is hydrogen or $C_1$–$C_3$alkyl, CONH—R in which R has its previous significance, $SO_2$NH—R in which R has its previous significance, NH—COR in which R has its previous significance, or $SO_3M$, wherein M has its previous significance, or, if n is 1, $R_2$ can also be CO—$R_3$ in which $R_3$ is $C_1$–$C_3$alkyl or phenyl, in that photographic material.

Preferable in this process are compounds of the formula (I) wherein X is NH.

Preferably in compounds of the formula (I) for this process M is hydrogen, Na, K, Ca, Mg, ammonium, mono-, di-, tri- or tetra-$C_1$–$C_4$alkylammonium, mono-, di- or tri-$C_1$–$C_4$hydroxyalkylammonium or ammonium that is di- or tri-substituted with a mixture of $C_1$–$C_4$alkyl and $C_1$–$C_4$hydroxyalkyl groups. Preferably each M is Na.

A halogen substituent $R_2$ may be fluorine, bromine or iodine but is preferably chlorine.

In the compounds of formula (I), n is preferably 1 and $R_2$ is preferably hydrogen, methyl, chlorine, cyano, COOH, COO-methyl, $CONH_2$, CONH-methyl, $SO_2NH_2$, $SO_2$NH-methyl or NH—COmethyl.

Preferably, each of the aminoacid residues $R_1$ is the same. Examples of preferred aminoacid residues $R_1$ include those having the formula —NH—CH($CO_2H$)—$R_3$ in which $R_3$ is hydrogen or a group having the formula —$CHR_4R_5$ in which $R_4$ and $R_5$, independently, are hydrogen or $C_1$–$C_4$alkyl optionally substituted by one or two substituents selected from hydroxy, thio, methylthio, amino, carboxy, sulfo, phenyl, 4-hydroxyphenyl, 3,5-diiodo-4-hydroxyphenyl, β-indolyl, β-imidazolyl and NH═C($NH_2$)NH—.

Specific examples of aminoacids from which such preferred aminoacid residues $R_1$ are derived include glycine, alanine, sarcosine, serine, cysteine, phenylalanine, tyrosine (4-hydroxyphenylalanine), diiodotyrosine, tryptophan (β-indolylalanine), histidine (β-imidazolylalanine), α-aminobutyric acid, methionine, valine (α-aminoisovaleric acid), norvaline, leucine (α-aminoisocaproic acid), isoleucine (α-amino-β-methylvaleric acid), norleucine (α-amino-n-caproic acid), arginine, ornithine (α,δ-diaminovaleric acid), lysine (α,ε-diaminocaproic acid), aspartic acid (aminosuccinic acid), glutamic acid (α-aminoglutaric acid), threonine, hydroxyglutamic acid and taurine, as well as mixtures and optical isomers thereof. Of these aminoacids from which such preferred aminoacid residues $R_1$ are derived, sarcosine, taurine, glutamic acid and aspartic acid are particularly preferred.

A further preferred example of an aminoacid from which an aminoacid residue $R_1$ may be derived is iminodiacetic acid.

Other, less preferred examples of aminoacids from which aminoacid residues $R_1$ may be derived include cystine, lanthionine, proline and hydroxyproline.

In addition to the above-mentioned preferred classical aminoacids, $R_1$ may also be the residue of an aromatic aminoacid such as p-aminobenzoic acid.

More specifically, a process is preferred which incorporates compounds of the formula (I) wherein X is NH; n is 1, p is 0, $R_1$ is derived from glutaric acid or iminodiacetic acid, $R_2$ is hydrogen or $SO_3M$, and M is sodium.

Additionally, a process for removing stain in a photographic material is preferred which process comprises incorporation of at least one compound of the formula (I) in combination with another optical brightener of the formula (II)

(II)

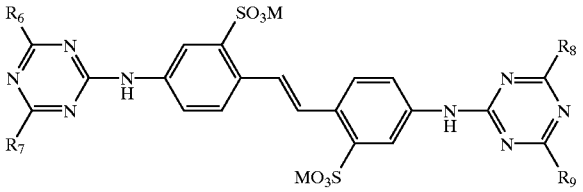

wherein $R_6$ to $R_9$ may be the same or different and each represents a hydroxyl group, an alkoxy group having 1 to 4 carbon atoms such as a methoxy, ethoxy or methoxyethoxy group, an amino group, an alkylamino group having 1 to 6 carbon atoms such as methylamino, ethylamino, propylamino, dimethylamino, cyclohexyamino, di-(beta-hydroxyethyl)-amino, beta-sulfoethylamino, N-(beta-sulfoethyl)-N-methylamino or beta-carboxylethylamino group, an aryloxy group such as a phenoxy or p-sulfophenyl group, an arylamino group such as an anilio, o-, m- or p-sulfoanilino, o-, m- or p-chloranilino, o-, m- or p-toluidino, o-, m- or p-carboxyanilino, o-, m- or p-anisidino or o-, m- or p-hydroxyanilino group, or a halogen atom and M is a monovalent cation such as a sodium or potassium ion.

A process comprising the steps of development, bleaching, fixing, water-washing and/or stabilizing wherein at least one compound of the formula (I) or at least one compound of the formula (I) in combination with at least one compound of the formula (II) is incorporated in at least one of these steps is claimed:

A process comprising at least one compound of the formula (I) or at least one compound of the formula (I) in combination with at least one compound of the formula (II) in the step of development is preferred as well as a process comprising at least one compound of the formula (I) or at least one compound of the formula (I) in combination with at least one compound of the formula (II) in the steps of bleaching and/or fixing.

A photographic processing solution comprising at least one compound of formula (I) or at least one compound of the formula (I) in combination with at least one compound of the formula (II) is claimed as well. Also claimed is a photographic paper comprising in at least one layer at least one compound of formula (I) or at least one compound of the formula (I) in combination with at least one compound of the formula (II). What is also claimed is the use of at least one compound of the formula (I) or the use of at least one compound of the chloride, polyethylene and polyvinyl acetate or polyurethanes. A preferred binder consists of styrene/butyl acrylate or styrene/butadiene/ acrylic acid copolymers or styrene/butadiene rubbers. Other polymer latices are described, for example, in U.S. Pat. Nos. 3,265,654, 3,657,174, 3,547,899 and 3,240,740.

The optional water-soluble protective colloid may be, e. g., soya protein, casein, carboxymethylcellulose, natural or modified starch, chitosan or a derivative thereof or, especially, polyvinyl alcohol. The preferred polyvinyl alcohol protective colloid component may have a wide range of saponification levels and molecular weights; e. g. a saponification level ranging from 40 to 100; and an average molecular weight ranging from 10,000 to 100,000.

Recipes for coating compositions for paper are described, for example, in J. P. Casey "Pulp and Paper"; Chemistry and Chemical Technology, 2nd edition, Volume III, pages 1684–1649 and in "Pulp and Paper Manufacture", 2nd and 5th edition, Volume II, page 497 (McGraw-Hill).

The paper coating compositions used according to the process of the present invention preferably contain 10 to 70% by weight of a white pigment. The binder is preferably used in an amount which is sufficient to make the dry content of polymeric compound up to 1 to 30% by weight, preferably 5 to 25% by weight, of the white pigment. The amount of fluorescent brightener preparation used according to the invention is calculated so that the fluorescent brightener is preferably present in amounts of 0.01 to 1% by weight, more preferably 0.05 to 1% by weight, and especially 0.05 to 0.6% by weight, based on the white pigment.

The paper coating composition used in the process according to the invention can be prepared by mixing the components in any desired sequence at temperature from 10 to 100° C., preferably 20 to 80° C. The components here also include the customary auxiliaries which can be added to regulate the Theological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, formula (I) in combination with at least one compound of the formula (II) to remove stain from a photographic material.

It is also an object. of the invention to provide higher concentrated photographic processing solutions which include at least one compound of the formula (I) or at least one compound of the formula (I) in combination with at least one compound of the formula (II) to prevent stain formation.

Most of the compounds of formula (I) are excellent fluorescent whitening agents for substrates such as papers and, in particular, for photographic papers, photographic development solutions or e. g. textiles as well.

When used for the fluorescent whitening of photographic paper, the compound of formula (I) according to the present process invention may be applied to the paper substrate in the form of a paper coating composition, or directly in the size press.

In one preferred aspect, the present invention provides a process for the fluorescent whitening of a photographic paper surface, comprising contacting the paper surface with a coating composition comprising a white pigment; a binder dispersion; optionally a water-soluble co-binder; and sufficient of a fluorescent whitening agent having the formula (I) according to the present invention, to ensure that the treated paper contains 0.01 g to 1 g per square meter.

As the white pigment component of the paper coating composition used according to the process of the present invention, there are preferred inorganic pigments, e. g., aluminium or magnesium silicates, such as China clay and kaolin and, further, barium sulfate, satin white, titanium dioxide , calcium carbonate (chalk) or talcum; as well as white organic pigments.

The paper coating compositions used according to the process of the present invention may contain, as binder, inter alia, plastics dispersions based on copolymers of butadiene/styrene, acrylonitrile/butadiene/styrene, acrylic acid esters, acrylic acid esterslstyrene/acrylonitrile, ethylene/vinyl chloride and ethylene/vinyl acetate; or homopolymers, such as polyvinyl chloride, polyvinylidene copolymers of ethylene oxide and propylene oxide, polyvinyl alcohol, water-soluble condensation products of formaldehyde with urea or melamine, polyphosphates or polyacrylic acid salts.

The coating composition used according to the process of the present invention is preferably used to produce coated printed or writing paper, or special papers such as cardboard or photographic papers.

The coating composition used according to the process of the invention can be applied to the substrate by any conventional process, for example with an air blade, a coating blade, a roller, a doctor blade or a rod, or in the size press, after which the coatings are dried at paper surface temperatures in the range from 70 to 200° C., preferably 90 to 130° C., to a residual moisture content of 3–8%, for example with infra-red driers and/or hot-air driers. Comparably high degrees of whiteness are thus achieved even at low drying temperatures.

By the use of the method according to the invention, the coatings obtained are distinguished by optimum distribution of the dispersion fluorescent brightener over the entire surface and by an increase in the level of whiteness thereby achieved, by a high fastness to light and to elevated temperature (e.g. stability for 24 hours at 60–100° C.) and excellent bleed-fastness to water.

In a second preferred aspect, the present invention provides a process for the fluorescent whitening of a paper surface comprising contacting the paper in the size press with an aqueous solution containing a size, optionally an inorganic or organic pigment and 0.1 to 20 g/l of a fluorescent whitening agent having the formula (I). Preferably, the size is starch, a starch derivative or a synthetic sizing agent, especially a water-soluble copolymer.

The optical brighteners of the invention can be synthesized by methods described in the applications WO96/00221 and WO98/42685.

The compounds of formula (I) may be produced by reacting, under known reaction conditions, cyanuric chloride, successively, in any desired sequence, with each of 4,4'-diamino-2,2'-stilbene disulfonic acid, an amino compound capable of introducing a group

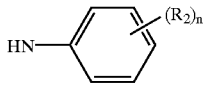

in which $R_2$ and n have their previous significance, and a compound capable of introducing a group $R_1$, in which $R_1$ has its previous significance.

The starting materials are known compounds which are readily available.

Processing of colour photographic material usually comprises a colour developer solution, a bleaching bath, a fixing bath (the two latest being sometimes combined in a bleach-fix bath) and a washing solution. The stain removing agents of the invention can be incorporated in any of the above mentioned solutions, in concentrations ranging from 0.1 g/L to 10 g/L. However, they are preferably incorporated in the colour developer solution or the bleach-fix solution, more preferably in the colour developer solution. They can also be incorporated into solid colour processing formulations.

The colour developing solution to be used is preferentially an alkaline solution of a colour developer and a variety of preservatives, for instance hydroxylamines, hydrazines, aromatic polyhydroxy compounds, polyethylenediamine, sulfites and bisulfites. The colour developing agents to be used are aromatic primary amine compounds, in particular those of a p-phenylenediamine type, for example, 4-amino-N,N-diethylaniline, 3-methyl-4-amino-N,N-diethylaniline, 4-amino-N-ethyl-N-b-hydroxyethylaniline, 3-methyl-4-amino-N-ethyl-N-b-hydroxyethylaniline, 3-methyl-4-amino-N-ethyl-N-b-methanesulfonamide ethylaniline, 3-methyl-4-amino-N-ethyl-N-b-methoxyethylaniline, 3-b-methanesulfonamideethyl-4-amino-N,N-diethylaniline, 3-methoxy-4-amino-N-ethyl-N-b-hydroxyethylaniline, 3-methoxy-4-amino-N-ethyl-N-b-methoxy ethylaniline, 3-acetamide-4-amino-N,N-diethylaniline, 4-amino-N,N-diethylaniline, N-ethyl-N-b-[b-(b-methoxyethoxy)ethoxy]ethyl-3-methyl-4-aminoaniline, N-ethyl-N-b-(b-methoxyethoxy)ethyl-3-methyl-4-aminoaniline and the salts thereof such as sulfate, chloride, sulfite, p-toluene sulfonate, and the like.

Other developing agents described in Research Disclosure No 38957 (September 1996) are included by reference. The pH value of the developer solution are about 9–13. Examples of bleaching agents used in the bleaching and/or in the bleach-fix solutions include polyvalent metal compounds such as those of iron (III), cobalt(III), chromium(IV) and copper(II); peracids, quinones and nitro compounds and most preferred are complexes of iron(III) with organic acids. Specific examples of preferred agents include complexes of iron(III) and aminopolycarboxylic acids such as ethylenediaminetetraacetic acid, diethylenetriaminepentaacetic acid, cyclohexanediaminetetraacetic acid, methyliminodiacetic acid and glycol ether diaminetetraacetic acid. These complexes can be used in a variety of combinations as described in Research Disclosure No 24023 (April, 1984). The bleach and/or bleach-fix solutions can further comprise bleaching accelerators (such a described in Research Disclosure No 17129 (July 1978), JP Kokoku No 53-11854 and U.S. Pat. No. 4,552,834), halides such as potassium iodide and ammonium bromide, nitrate ions for preventing corrosion, surfactants.

The bath having fixing ability comprises fixing agents such as thiosulfates, thioethers, thiourea and iodides. Examples of such solutions given in Research Disclosure No. 37336 (May 1995) and references therein are included by reference.

The attempt to develop colour-photographic recording materials even more quickly and in doing so to use chemicals which are easier to handle and less polluting has led to considerable restrictions in the choice of components of the system. Thus the silver halide emulsions used are those based substantially or exclusively on silver chloride, thereby reducing the development time. It has also been found that developer systems largely or totally devoid of benzyl alcohol can be used without any reduction in the colour density. This makes it possible to produce developer concentrates from fewer constituents, with shorter mixing times and reduced toxicity of the used developer. In order to achieve this aim of shortening the development time and reducing the amount of benzyl alcohol, the following additives may be used:

a) N-substituted hydroxylamines as antioxidants in place of the customary hydroxylamines,
b) development accelerators, for example 1-aryl-3-pyrazolones, hydrazine derivatives, quaternary ammonium and phosphonium compounds, or polyoxyalkylene compounds,
c) triethanolamine as tar inhibitor,
d) lithium salts, for example those of polystyrenesulfonates,
e) aromatic polyhydroxy compounds, for example sodium 5,6-dihydroxy-1,2,4-benzenetrisulfonate.

The temperature of the processing is 25° C. to 45° C., preferably 30° C. to 40° C. Higher temperatures are preferred for rapid processing.

Triazinyl stilbene optical brighteners of formula (I) can be used either alone, or in combination with other optical brighteners of the same or of a different class, such as those described in U.S. Pat. Nos. 4,587,195 and 5,043,253.

The colour photographic material to be processed comprises at least one light-sensitive silver emulsion layer coated onto a support material. Examples of such material are colour negative films, colour negative paper, colour reversal film, colour reversal photographic paper, sensitive materials for dye diffusion transfer or silver-bleach material.

Examples of suitable bases for the production of colour photographic materials are films and sheets of semisynthetic and synthetic polymers, such as cellulose nitrate, cellulose acetate, cellulose butyrate, polystyrene, polyvinyl chloride, polyethylene terephthalate and polycarbonate, and paper laminated with a barytes layer or an a-olefin polymer layer (e.g. polyethylene). These bases can have been coloured with dyes or pigments, for example titanium dioxide. They can also have been coloured black for the purposes of light shielding. The surface of the base is generally subjected to a treatment for improving the adhesion of the photographic emulsion layer, for example corona discharge with subsequent application of a substrate layer.

In a preferred application, the colour photographic material is a colour negative paper comprising on a coated paper support at least one red-sensitized silver emulsion containing at least one cyan coupler, at least one blue-sensitized silver emulsion containing at least one yellow coupler, at least one green-sensitized silver emulsion containing at least one magenta coupler, interlayers and at least one protecting layer.

The colour photographic recording material used in the novel process is preferably a material having the following layer sequence:

| | |
|---|---|
| a | a: Protective layer |
| b | b: Interlayer (may be absent) |
| c | c: Red-sensitive layer |
| d | d: Interlayer |
| e | e: Green-sensitive layer |
| f | f: Interlayer |
| g | g: Blue-sensitive layer |
| h | h: Base |

In another preferred aspect of the invention a stain removing agent of the formula (I) or a stain removing agent of the formula (I) in combination with a stain removing agent of the formula (II) is incorporated in at least one of the layers a to g as depicted above.

Preferred photographic recording materials to be processed with the method of the invention are those in which the silver halide present in the blue-, green- and/or red-sensitive layer is silver chlorobromide of which at least 90 mol % consists of silver chloride.

Components of the photographic material to be processed with the method of the invention are exemplified in the following publications, but the invention is not limited to these examples:

| | |
|---|---|
| Vehicles, Binders | RD 38957, p. 598–601 |
| Chemical sensitizers | RD 38957, p. 601–603 |

-continued

| | |
|---|---|
| Spectral sensitizing agents | RD 38957, p. 603–607 |
| Colour couplers | RD 38957, p. 616–618 |
| UV absorbers | US 5,300,414, NL 1 007 590 |
| Stabilisers and antifoggants | RD 38957, p. 607–610 |
| Optical brighteners | RD 38957, p. 607, right column |
| Absorption and antihalation dyes | RD 38957, p. 611–612 |
| Silver emulsion grains | RD 38957, p. 592–598 |
| Coating aids, surfactants | RD 38957, p. 612–613 |

Essential constituents of the colour-photographic emulsion layers are binders, silver halide particles and colour couplers.

The photographic emulsions can be spectrally sensitized using methine dyes or other dyes. Particularly suitable dyes are cyanine dyes and merocyanine dyes, including complex merocyanine dyes.

An overview of the polymethine dyes which are suitable as spectral sensitizers, their appropriate combinations and supersensitizing combinations is given in Research Disclosure 17643 (December 1978), Chapter IV.

The differently sensitized emulsion layers are allocated non-diffusing monomeric or polymeric colour couplers, which may be located in the same layer or in an adjacent layer. It is common to assign cyan couplers to the red-sensitive layers, magenta couplers to the green-sensitive layers and yellow couplers to the blue-sensitive layers.

Yellow couplers which can be used in the material are preferably compounds of the formula A (A)

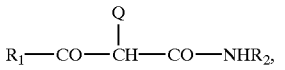

in which $R_1$ is alkyl, cycloalkyl, arylamino, anilino, a heterocyclic group or aryl, $R_2$ is aryl and Q is hydrogen or a group which can be eliminated by reaction with the oxidized developer. Examples of yellow couplers are given in U.S. Pat. Nos. 2,407,210, 2,778,658, 2,875,057, 2,908,513, 2,908,573, 3,227,155, 3,227,550, 3,253,924, 3,265,506, 3,277,155, 3,408,194, 3,341,331, 3,369,895, 3,384,657, 3,415,652, 3,447,928, 3,551,155, 3,582,322, 3,725,072, 3,891,445, 3,933,501, 4,115,121, 4,401,752 and 4,022,620, in DE-A 1,547,868, 2,057,941, 2,162,899, 2,163,813, 2,213,461, 2,219,917, 2,261,361, 2,261,362, 2,263,875, 2,329,587, 2,414,006 and 2,422,812, in GB-A 1,425,020 and 1,077,874 and in JP-A-88/123,047 and in EP-A-447,969.

Magenta couplers can, for example, be simple 1-aryl-5-pyrazolones, or pyrazole derivatives fused with 5-membered hetero-rings, for example imidazopyrazoles, pyrazolopyrazoles, pyrazolotriazoles or pyrazolotetrazoles.

One group of magenta couplers comprises 5-pyrazolones of the formula C (C)

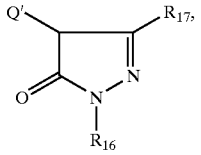

as are described in British Patent 2,003,473. In this formula, $R_{16}$ is hydrogen, alkyl, aryl, alkenyl or a heterocyclic group, $R_{17}$ is hydrogen, alkyl, aryl, a heterocyclic group, an ester group, alkoxy group, alkylthio group, carboxyl group, arylamino group, acylamino group, (thio)urea group, (thio) carbamoyl group, guanidino group or sulfonamido group. Examples of such tetraequivalent magenta couplers are given in U.S. Pat. Nos. 2,983,608, 3,061,432, 3,062,653, 3,127,269, 3,152,896,3,311,476, 3,419,391, 3,519,429, 3,558,319, 3,582,322, 3,615,506, 3,684,514, 3,834,908, 3,888,680, 3,891,445, 3,907,571, 3,928,044, 3,930,861, 3,930,866 and 3,933,500 and in JP-A-89/309,058. Examples of diequivalent magenta couplers are described in U.S. Pat. Nos. 3,006,579, 3,419,391, 3,311,476, 3,432,521, 3,214,437, 4,032,346, 3,701,783, 4,351,897, 3,227,554, in EP-A-133,503, DE-A-2,944,601, JP-A-78/34044, 74/53435, 74/53436, 75/53372 and 75/122935.

Magenta couplers used can also be pyrazoles fused with 5-membered heterocycles, and are then known as pyrazoloazoles. Magenta couplers of the pyrazoloazole type which are likewise preferred may be represented by the formula

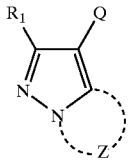

in which $R_1$ is hydrogen or a substituent, Z represents the non-metallic atoms necessary to complete a 5-membered ring containing 2 or 3 nitrogen atoms, which ring may be substituted, and Q is hydrogen or a leaving group.

Of these compounds, preference is given to magenta couplers of the formulae (M-a)

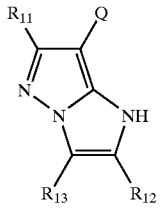

(M-b)

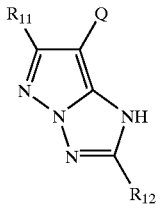

(M-c)

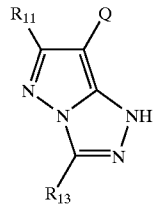

-continued (M-d)

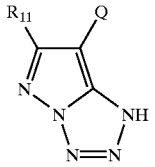

$R_{11}$, $R_{12}$, $R_{13}$ are independently of each other hydrogen, alkyl, aryl, alkoxy, aryloxy, alkylthio, arylthio, ureido, urethane, acylamino, a heterocyclic ring, alkoxycarbonyl, carbamoyl, sulfamoyl, sulfinyl, acyl or cyano Q is hydrogen or a leaving group such as halogen, alkoxy, aryloxy, acyloxy, alkyl- or aryl-sulfonyloxy, acylamino, alkyl- or arylsulfonamido, alkoxycarbonyloxy, aryloxycarbonyloxy, alkyl-, aryl- or heterocyclyl-S-carbamoylamino, a 5- or 6-membered nitrogen-containing heterocyclic radical, imido and arylazo. These groups may be further substituted as indicated for $R_{11}$.

Pyrazolotetrazoles are described in JP-A-85/33552; pyrazolopyrazoles in JP-A-85/43,695; pyrazoloimidazoles in JP-A-85/35732, JP-A-86/18949 and U.S. Pat. No. 4,500,630; pyrazolotriazoles in JP-A-851186,567, JP-A-86/47957, JP-A-85/215,687, JP-A-85/197,688, JP-A-85/172,982, EP-A-1 19,860, EP-A-173,256, EP-A-178,789, EP-A-178,788 and in Research Disclosure 84/24,624. Further pyrazoloazole magenta couplers are described in: JP-A-86/28,947, JP-A85/140,241, JP-A-85/262,160, JP-A-85/213,937, JP-A-87/278,552, JP-A-87/279,340, JP-A-88/100,457, EP-A-177,765, EP-A-176,804, EP-A-170,164, EP-A-164,130, EP-A-1 78,794, DE-A-3,516,996, DE-A-3,508,766 and Research Disclosure 81/20919, 84/24531 and 85/25758.

Cyan couplers can, for example, be derivatives of phenol, 1-naphthol, pyrazoloazole, pyrroloazole or of pyrazoloquinazolone. One group of cyan couplers is of the formula E (E)

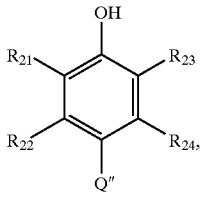

in which $R_{21}$, $R_{22}$, $R_{23}$ and $R_{24}$ are hydrogen, halogen, alkyl, carbamoyl, amino, sulfonamido, phosphoramido or ureido. An exhaustive listing of cyan couplers can be found in U.S. Pat. No. 4,456,681.

Phenolic cyan couplers employed in the red-sensitive silver halide emulsion layer of the material processed by the novel method are preferably of the formula (E-12) and/or (E-13)

(E-12)

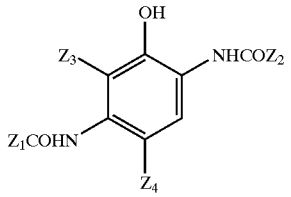

(E-13)

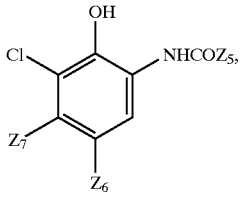

in which $Z_1$ is alkyl, aryl, $Z_2$ is alkyl, cycloalkyl, aryl, a heterocyclic group or a ballast group, $Z_3$ is hydrogen or halogen, $Z_1$ and $Z_3$ together can form a ring, and $Z_4$ is hydrogen or a leaving group, and $Z_5$ is a ballast group, $Z_6$ is hydrogen or a leaving group and $Z_7$ is alkyl 1-Naphtol cyan couplers are represented by formula (E20)

(E-20)

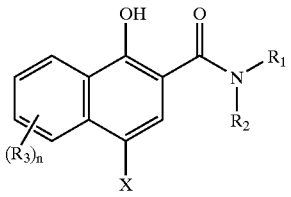

in which $R_1$ is preferably substituted phenyl and $R_2$ and $R_3$ are preferably H and X is preferably H or a group which is cleaved by reaction with the oxidized form of the developer.

Another class of cyan couplers that can be used in photographic material to be processed by the method of the invention are represented by formula (E21)

(E-21)

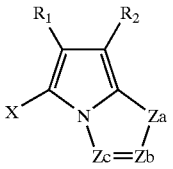

in which Za is —NH— or —CH($R_3$)—; Zb and Zc independently of one another are —C($R_4$)= or —N=; $R_1$, $R_2$ and $R_3$ are each an electron-attracting group having a Hammett substituent constant $\sigma_p$ of at least 0.2, with the sum of the $\sigma_p$ values of $R_1$ and $R_2$ being at least 0.65; $R_4$ is H or a substituent, and if two $R_4$'s are present in the formula, they can be identical or different; and X is H or a group capable of elimination in the coupling reaction with the oxidation product of an aromatic primary amine as colour developer; or $R_1$, $R_2$, $R_3$, $R_4$ or X is a divalent group by means of which the cyan coupler is able to form a dimer or higher polymer, or to react with a polymer chain to form a homo- or copolymer.

Examples of cyan couplers are given in the following documents: U.S. patents Nr. U.S. Pat. Nos. 2,369,929, 2,423,730, 2,434,272, 2,474,293, 2,521,293, 2,521,908, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,560, 3,476,563, 3,516,831, 3,560,212, 3,582,322, 3,583,971, 3,591,383, 3,619,196, 3,632,347, 3,652,286, 3,737,326, 3,758,308, 3,839,044, 3,880,661, 4,004,929, 4,124,396, 4,333,999, 4,463,086, 4,456,681, 4,873,183, 4,923,791, 5,143,824, 5,256,526, 5,269,181, 5,262,293, 5,270,153, 5,306,610, 5,547,825, 5,578,436, EP-A-0354549, EP-A0398664, EP-A-456226, EP-A-0484909, EP-A-0487111, EP-A-0488248, EP-A-0491197, EP-A-0544316, EP-A-0545300, EP-A-0545305, EP-A-0556777, EP-A-0578248, EP-A-0608133, EP-A-0717315, EP-A-0718688, EP-A-718689, EP-A-681216, EP-A-718687, EP-A-718688, EP-A-717315, EP-A-744655, EP-B-487111, JP-A-3,240,053, JP-A-3,284,746, JP-A-4,009,050, JP-A-4,043,346, JP-A-4,125,557, JP-A-5,262,293, JP-A-5,306,610, JP-A-6,083,000, JP-A-6,083,001, JP-A-07-234484, JP-A-07-234486, JP-A-07-24894, JP-A-07-281371, JP-A-07-333794, JP-A-08-022109, JP-A-08-029931, JP-A-08-044015, JP-A-08-122985, JP-A-08-166660, JP-A-08-211578, JP-A-254799, JP-A-08-262662, JP-A-08-320540, JP-A-08-314082 and JP-B-2526243.

Examples of such UV absorbers to be incorporated in the colour photographic paper of the present method are benzotriazoles, 2-hydroxybenzophenones, oxanilides, cyanoacrylates, salicylic esters, acrylonitrile derivatives or thiazolines, and 2-hydroxyphenyltriazines.

Such UV absorbers are described in more detail, for example, in the following publications: U.S. Pat. Nos. 3,314,794, 3,352,681, 3,705,805, 3,707,375, 4,045,229, 3,700,455, 3,700,458, 3,533,794, 3,698,907, 3,705,805, 3,738,837, 3,762,272, 4,163,671, 4,195,999, 4,309,500, 4,431,726, 4,443,543, 4,576,908, 4,749,643, 5500332, 5455152, GB-A-1,564,089, GB-A-2,293,608, EP-A-190,003, -747755, -717313 and JP-A-71/2784, 81/111,826, 81/27,146, 88/53,543, 88/55,542 and 96/69087.

Benzotriazoles UVabsorbers are, especially the 2-(2-hydroxyphenyl)benzotriazoles (HBT) of the formula

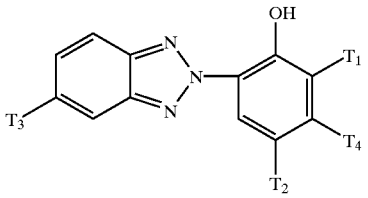

in which $T_1$ and $T_2$ independently of one another are hydrogen, halogen, alkyl, alkyl substituted by $COOT_5$, alkoxy, aryloxy, hydroxyl, aralkyl, aryl or acyloxy, where $T_5$ is alkyl or alkyl interrupted by one or more O or $T_1$ is a group of the formula

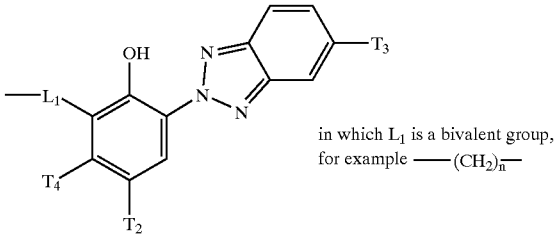

in which $L_1$ is a bivalent group, for example $—(CH_2)_n—$ where n is from the range 1–8, $T_3$ is hydrogen, halogen, alkyl, alkoxy, aryloxy, acyloxy; $—CF_3$, phenyl, $—S—T_6$, $—SO_2—T_6$; and $T_4$ is hydrogen, hydroxyl, alkoxy, aryloxy or acyloxy or a group of one of the formulae $—OCH_2CH(OT_8)—CH_2—O—T_7$ or $—OCH_2CH_2—O—CO—T_7$;

$T_6$, $T_7$ are independently alkyl or aryl;

$T_8$ is hydrogen or $CO—T_9$;

$T_9$ is alkyl or alkenyl;

and polymers prepared using these compounds. Preference is given to those benzotriaizole UV absorbers which are liquid in the temperature range around 20° C. or form a liquid phase in a mixture with other substances, especially to those in which $T_1$ and $T_2$ independently of one another are hydrogen, halogen, alkyl, alkyl substituted by $COOT_5$, alkoxy, aryloxy, hydroxyl, aralkyl, aryl or acyloxy, where $T_5$ is alkyl or alkyl which is interrupted by one or more O.

Within the scope of the stated definitions $T_1$, $T_2$, $T_3$ and $T_4$ may also carry additional substituents, for example an ethylenically unsaturated, polymerizable group. Dimers or polymers are also possible.

2-hydroxyphenyltriazines UV absorbers are of formula

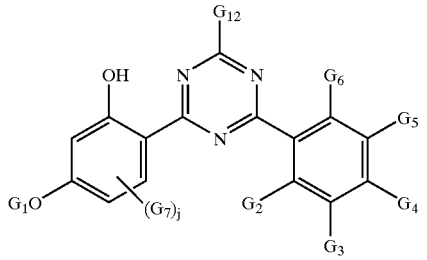

in which j is 0, 1, 2 or 3;

$G_1$ is alkyl, alkenyl or cycloalkyl;

$G_2$ and $G_6$ independently of one another are H, OH, halogen, alkyl, alkoxy, halomethyl, for example $CF_3$;

$G_3$, $G_5$ and $G_7$ independently of one another are H, OH, $OG_1$, halogen, alkyl, halomethyl, for example $CF_3$;

$G_4$ is H, OH, $OG_1$, halogen, alkyl, phenyl, halomethyl, for example $CF_3$, or alkenyl; and $G_{12}$ is alkyl, phenylalkyl, cycloalkyl, $OG_1$, or in particular, a group of the formula

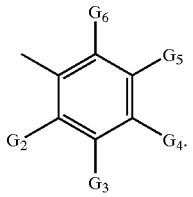

Alkyl or alkenyl substituents, or substituents which are aromatic or aliphatic ring systems, usually contain—within the context of the stated definitions—from 1 to 50 carbon atoms and can be interrupted one or more times by O, S, NR', $SO_2$, CO, phenylene, cyclohexylene, COO, OCO, —($SiR_pR_qO$)— and/or substituted one or more times by OH, OR', NR'R", halogen, —CN, alkenyl, phenyl, —$SiR_pR_qR_r$ or COOH, where R' and R" independently of one another are H, alkyl, alkenyl or acyl, and $R_p$, $R_q$ and $R_r$ independently of one another are H, alkyl, alkenyl, phenyl, alkoxy, acyl or acyloxy.

The above-mentioned groups can also carry other substituents as well. Dimers or polymers are also possible.

The photographic material of the present process may also contain phenolic compounds which act as light stabilizers for the colour image and as colour cast inhibitors. They may be present in a photosensitive layer (colour layer) or in an interlayer, alone or together with other additives. Such compounds are described in greater detail, for example, in the following publications: U.S. Pat. Nos. 3,700,455, 3,591, 381, 3,573,052, 4,030,931, 4,174,220, 4,178,184, 4,228,235, 4,279,990, 4,346,165, 4,366,226, 4,447,523, 4,528,264, 4,581,326, 4,562,146, 4,559,297, GB-A-1,309,277, 1,547, 302, 2,023,862, 2,135,788, 2,139,370, 2,156,091; DE-A-2, 301,060, 2,347,708, 2,526,468,2,621,203, 3,323,448; DD-A-200,691, 214,468; EP-A-106,799, 113,124, 125,522, 159,912, 161,577, 164,030, 167,762, 176,845, 246,766, 320, 776; JP-A-74/134,326, 76/127,730, 76/30462, 77/3822, 77/154,632, 78/10842, 79/48535, 79/70830, 79/73032, 79/147,038, 79/154,325, 79/155,836, 82/142,638, 83/224, 353, 84/5246, 84/72443, 84/87456, 84/192,246, 84/192,247, 84/204,039, 84/204,040, 84/212,837, 84/220,733, 84/222, 836, 84/228,249, 86/2540, 86/8843, 86/18835, 86/18836, 87/11456, 87/42245, 87/62157, 86/6652, 89/137,258 and in Research Disclosure 79/17804.

Other substances which can be used as light or dark stabilizers are described in U.S. Pat. Nos. 5,534,390, 580, 710, 5,543,276, 5,763,144 or U.S. Pat. No. 5,780,625.

The photographic material used in the novel process may, furthermore, contain colour cast inhibitors. These prevent colour casts being formed due, for example, to reaction of the coupler with unintentionally oxidized developer or with by-products of the colour-formation process. Colour cast inhibitors of this kind are usually hydroquinone derivatives, but may also be derivatives of aminophenols, of gallic acid, ascorbic acid or of benzofuranone type.

Typical new examples of inhibitors of benzofuranone type are the following ones:

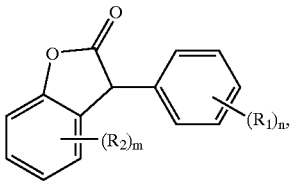

wherein n is 0, 1, 2, 3, 4 or 5, and m is 0, 1, 2, 3, 4 or 5, and $R_1$ are each independently of one another hydrogen, halogen, hydroxy, alkyl, alkoxy, alkylthio, ,alkenyl, alkenyloxy, alkynyl, alkynyloxy, phenylalkyl, phenylalkoxy, phenyl, phenoxy, cycloalkyl, cycloalkoxy, alkylamino, diamino, ,alkanoyl, alkanoyl, alkanoyloxy, alkanoylamino, alkenoyl, alkenoyloxy, cycloalkylcarbonyl, cycloalkylcarbonyloxy, benzoyl, benzoyloxy; or any two adjacent $R_1$'s form a benzene ring, and $R_2$, are each independently of one another hydrogen, chloro, hydroxy, alkyl, phenylalkyl, cycloalkyl, phenyl, alkoxy, alkylthio, alkylamino, dialkylamino, alkanoyloxy, alkanoylamino, alkenoyloxy, cycloalkylcarbonyloxy, benzoyloxy, or two $R_2$'s form a benzene ring.

Alkyl or alkenyl substituents, or substituents which are aromatic or aliphatic ring systems, usually contain—within the context of the stated definitions—from 1 to 50 carbon atoms and can be interrupted one or more times by O, S, NR', $SO_2$, CO, phenylene, cyclohexylene, COO, OCO, —($SiR_pR_qO$)— and/or substituted one or more times by OH, OR', NR'R", halogen, —CN, alkenyl, phenyl, —$SiR_pR_qR_r$ or COOH, where R' and R" independently of one another are H, alkyl, alkenyl or acyl, and $R_p$, $R_q$ and $R_r$ independently of one another are H, alkyl, alkenyl, phenyl, alkoxy, acyl or acyloxy.

The above-mentioned group scan also carry other substituents as well. Dimers or polymers are also possible.

Typical examples of these inhibitors are given in the following publications: U.S. Pat. Nos. 2,360,290, 2,336,327, 2,403,721,2,418,613, 2,675,314, 2,701,197, 2,704,713, 2,728,659, 2,732,300, 2,735,365, 5,516920; EP-A-1 24,877, EP-A-277,589, EP-A-338,785, EP-A-871 ,066; JP-A-75/92988, 75/92989, 75/93928, 75/110,337, 84/5,247 and 77/146,235.

Typical examples high-boiling point solvents are the esters of phthalic acid, phosphoric acid, citric acid, benzoic acid or of fatty acds, and also alkylamides and phenols. Further details regarding high-boiling solvents which can be used are given in the following publications:

phosphates: GB-A-791,219, BE-A-755,248, JP-A-76/76739, 78/27449, 78/218,252, 78/97573, 79/148,133, 82/216,177, 82/93323 and 83/216,177 and EP-A-265, 296.

phthalates: GB-A-791,219, JP-A-77/98050, 82/93322, 82/216,176, 82/218,251, 83/24321, 83/45699, 84/79888.

amides: GB-A-791,129, JP-A-76/105,043, 77/13600, 77/61089, 84/189,556, 87/239,149, U.S. Pat. No. 928, 741, EP-A-270,341, WO 88/00723.

phenols: GB-A-820,329, FR-A-1,220,657, JP-A-69/69946, 70/3818, 75/123,026, 75/82078, 78/17914, 78/21166, 82/212,114 and 83/45699.

Other oxygen-containing compounds: U.S. Pat. Nos. 3,748,141, 3,779,765, JP-A-73/75126, 74/101,114, 74/10115, 75/101,625, 76/76740, 77/61089, EP-A-304,810 and BE-A-826,039. Other compounds: JP-A-72/115,369, 72/130,258, 73/127,521, 73/76592, 77/13193, 77/36294, 79/95233, 91/2,748, 83/105,147 and Research Disclosure 82/21918.

Further details on the structure of colour photographic material, and the components which can be employed in the material, can be found, inter alia, in U.S. Pat. No. 5,538,840, column 27, line 25, to column 106, line 16, and in the publications cited therein; these passages of U.S. Pat. No. 5,538,840 are hereby incorporated by reference. Further important components, especially couplers, are described in U.S. Pat. No. 5,578,437.

As silver halide emulsions it is possible to use customary silver chloride, silver bromide or silver iodide emulsions or mixtures thereof, such as silver chlorobromide and silver chloroiodide emulsions, in which the silver halides may have all known crystal forms. The use of silver chloride emulsions is accorded particular importance in the material of this novel process. The preparation of such emulsions and their sensitization are described in RESEARCH DISCLOSURE, November 1989, No. 307, 105. This publication also mentions a range of binders for these emulsions, which may also be employed in the materials of this novel process. The same applies to the bases mentioned in the publication.

EXAMPLES

The examples which follow illustrate the invention in more detail without limiting it.

Example 1

The efficiency of the new process was tested by developing commercially available photographic colour papers in a model processing solution. For this purpose, samples were cut out of each of four commercial papers: Fuji SFA VIII, Kodak Edge 5, Konica QA6 and Agfa Typ 10. One half of each sample was exposed through filter combination determined to give equal density of the magenta, cyan and yellow dyes. The other half was hidden, to give white portion.

Exposure conditions:

| | Cibachrome filters | | | | | |
|---|---|---|---|---|---|---|
| Paper | Y | M | C | UV | Wratten 96 | Zeit |
| Fuji SFAVIII | 200 | 165 | 60 | 2C | 0.6 | 4" |
| Kodak Edge5 | 200 | 195 | 95 | 2C | 0.5 | 7" |
| Agfa Typ 10 | 230 | 170 | 85 | 2C | 0.5 | 7" |
| Konica QA6 | 205 | 220 | 65 | 2C | 0.5 | 7" |

A working processing solution was prepared by adding following components in a 1 L cylinder, under gentle mixing:

| Component | Amount |
|---|---|
| Water | 800 ml |
| Triethanolamine (TEA) 100% | 11.0 ml |
| Potassium sulfite, water free | 0.30 g |
| N,N diethyl-hydroxylamin, 85% solution | 6.0 ml |
| Lithium sulfate, water free | 2.7 g |
| Diethylenetriamine, pentaacetic acid, pentasodium salt, 40% solution | 0.8 ml |
| Potassium chloride, water free | 1.8 g |
| Potassium bromide, water free | 0.020 g |
| N-Ethyl,N-(bety-methanesulfonamidoethyl), 3-methyl-4-amino-aniline sulfate | 4.85 g |
| Potassium carbonate, water free | 25.0 g |
| Optical brightener | see table 1 |
| Water | fill up to 1 L |

As bleachfix, the commercially available Kodak RA4 solution was used.

Optical brightener agents tested were available in following formulation:

| Compound | Active substance | Formulation |
|---|---|---|
| A | 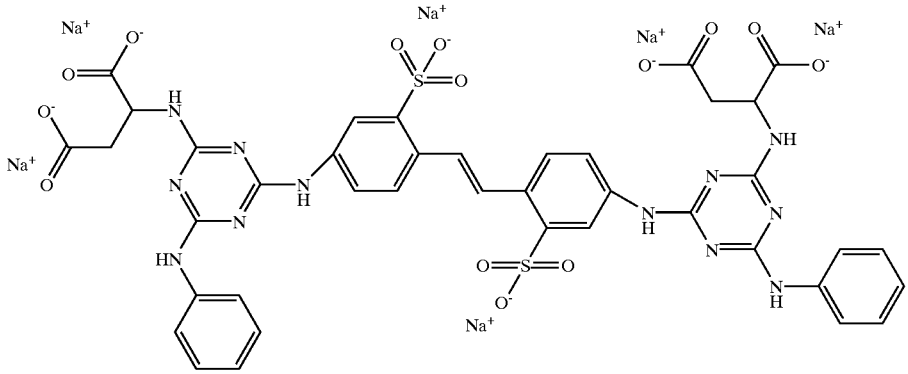 | 21% active substance 61% water 2% NaCl 16% PEG 300 liquid |

-continued
| Compound | Active substance | Formulation |
|---|---|---|
| B | 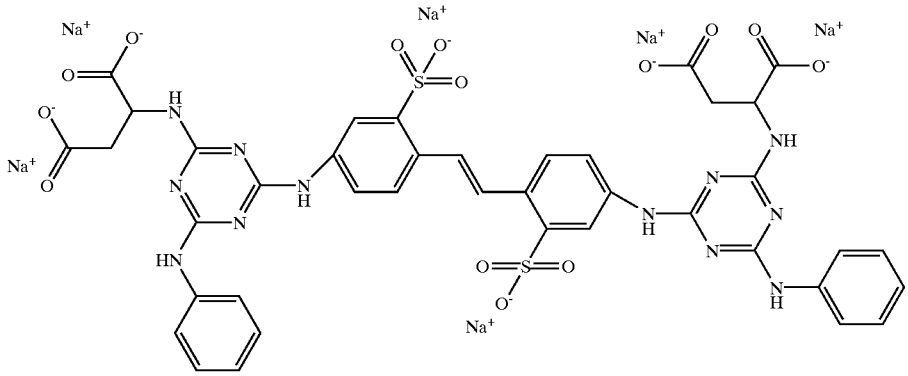 | 80.5% active substance<br>5.5% water<br>1.5% NaCl<br>6.5% PEG 300<br>6% by-products<br>solid |
| C | 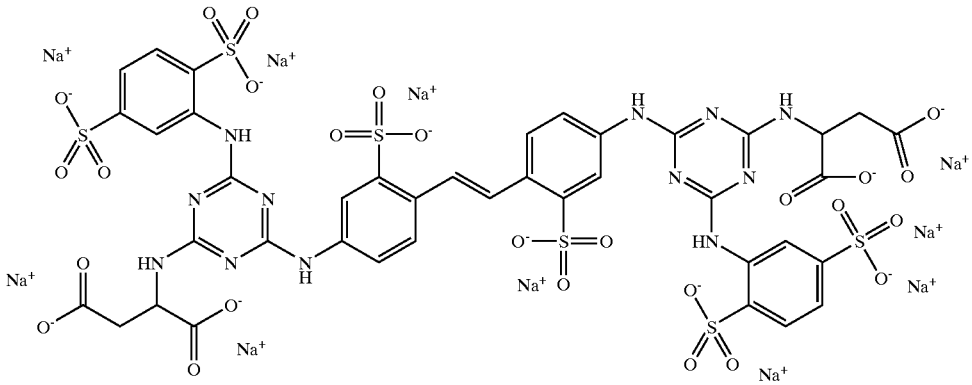 | 78% active substance<br>18% water<br>4% NaCl<br>solid |
| D | 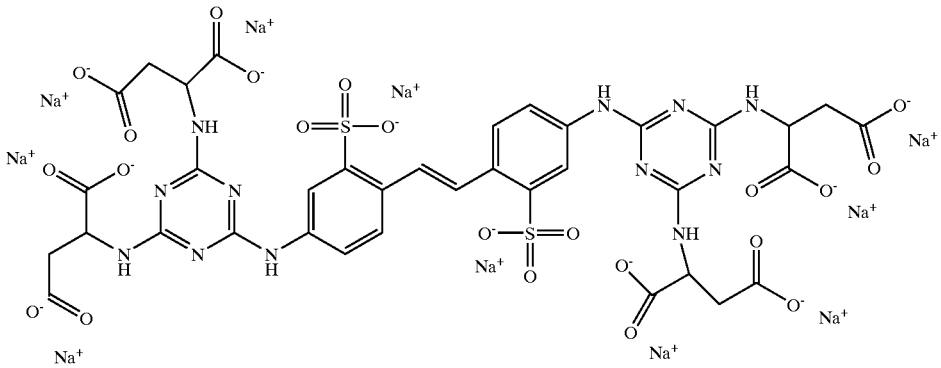 | 13.3% active substance<br>86.7% water<br>liquid |

-continued
| Compound | Active substance | Formulation |
|---|---|---|
| E | 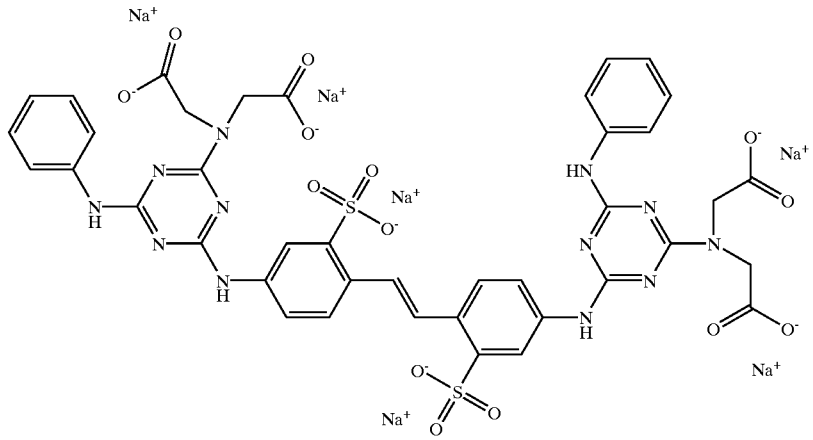 | 77% active substance 23% water solid |
| F | 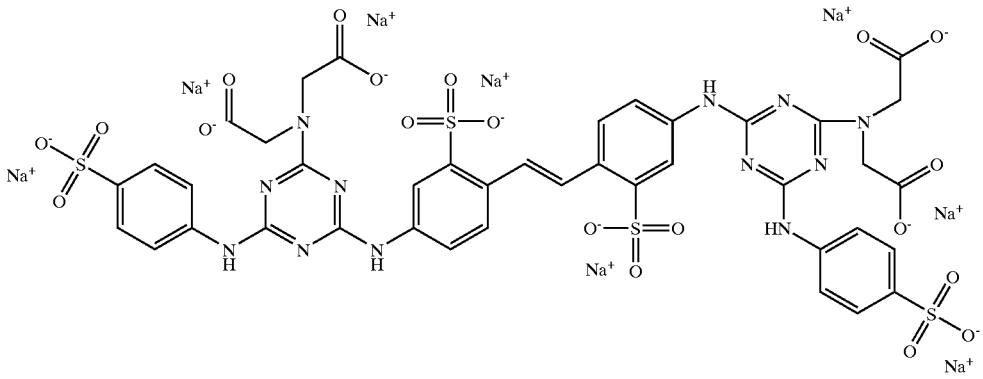 | 77% active substance 19% water 4% NaCl solid |
| G | 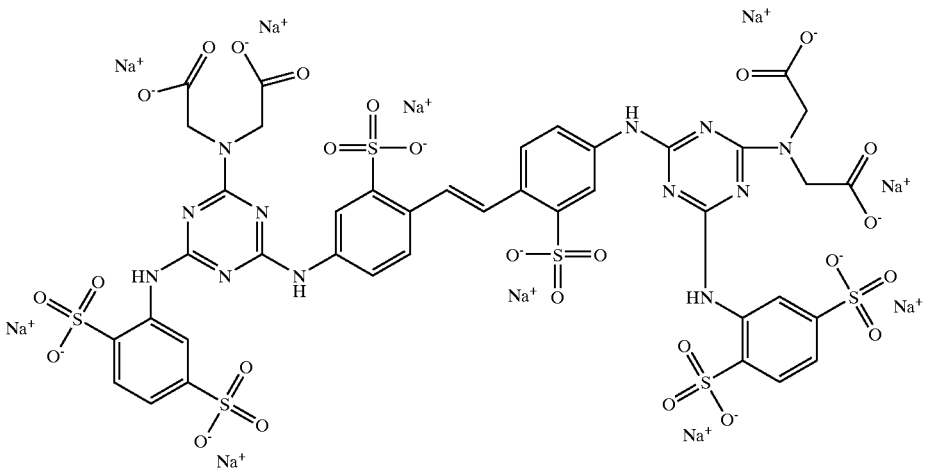 | 72% active substance 21% water 4% NaCl 3% by-products solid |

-continued

| Compound | Active substance | Formulation |
|---|---|---|
| H | 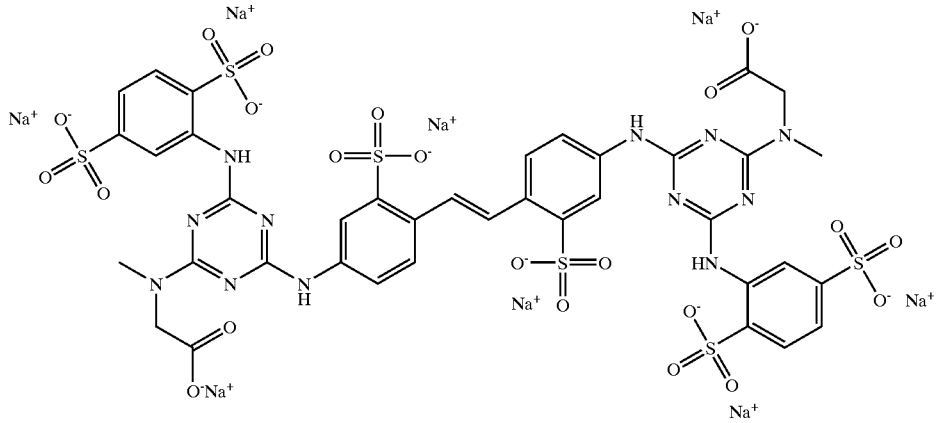 | 72% active substance 13% water 7% NaCl 8% by-products solid |

Samples (one of each paper) were developed together with a Jobo 2000 machine, using following program:

| | |
|---|---|
| prewash | 4 min |
| prewash | 30 sec |
| developer | 45 sec |
| bleach-fix | 45 sec |
| wash | 3 min 30 sec |

The CIE-L*a*b* values were measured with a Datacolor Elrepho 2000 densitometer in the D65/15° mode. The instrument was calibrated with a black standard and with $BaSO_4$ as white standard. The UV proportion of the lamp was also calibrated using a textile scale. Table 1 shows CIE-L*a*b* measurements of the white of papers processed with optical brighteners of present invention. The polar coordinates C (Chrominance) and H (Hue) are also given.

TABLE 1

| Paper | Additive | g/L formulation | g/L active substance | L* | a* | b* | C | H |
|---|---|---|---|---|---|---|---|---|
| Konica QA6 | none | comparative | | 90.86 | 0.1 | 3.3 | 3.25 | 90 |
| Konica QA6 | B | 1.20 | 1.0 | 90.74 | 0.1 | 0.1 | 0.11 | 65 |
| Konica QA6 | A | 2.38 | 0.5 | 90.56 | 0.4 | 1.6 | 1.65 | 76 |
| Konica QA6 | A | 5.76 | 1.0 | 90.37 | 0.1 | 1.5 | 1.50 | 90 |
| Konica QA6 | A | 7.14 | 1.5 | 90.91 | 0.2 | 1.0 | 0.96 | 82 |
| Konica QA6 | C | 0.64 | 0.5 | 90.77 | 0.1 | 1.6 | 1.55 | 90 |
| Konica QA6 | C | 1.28 | 1.0 | 90.86 | 0.1 | 1.2 | 1.20 | 90 |
| Konica QA6 | E | 1.30 | 1.0 | 90.94 | 0.2 | 1.9 | 1.86 | 84 |
| Konica QA6 | F | 1.30 | 1.0 | 90.88 | 0.1 | 1.7 | 1.70 | 90 |
| Konica QA6 | G | 1.40 | 1.0 | 90.85 | 0.2 | 1.4 | 1.41 | 83 |
| Konica QA6 | H | 0.70 | 0.5 | 90.75 | 0.2 | 0.5 | 0.47 | 73 |
| Konica QA6 | H | 1.40 | 1.0 | 90.98 | 0.0 | 0.2 | 0.20 | 90 |
| Kodak Edge5 | none | comparative | | 90.88 | −0.4 | 2.8 | 2.83 | 98 |
| Kodak Edge5 | B | 0.6 | 0.5 | 90.72 | −0.3 | −0.5 | 0.58 | 240 |
| Kodak Edge5 | B | 1.20 | 1.0 | 90.79 | −0.1 | −0.8 | 0.81 | 261 |
| Kodak Edge5 | B | 1.80 | 1.5 | 90.80 | −0.1 | −1.1 | 1.10 | 270 |
| Kodak Edge5 | A | 2.38 | 0.5 | 90.73 | −0.1 | −0.7 | 0.71 | 260 |
| Kodak Edge5 | A | 7.14 | 1.5 | 90.65 | −0.2 | −1.1 | 1.12 | 259 |
| Kodak Edge5 | C | 1.28 | 1.0 | 89.81 | −0.1 | 1.5 | 1.50 | 90 |
| Kodak Edge5 | E | 1.30 | 1.0 | 90.03 | 0.0 | 1.9 | 1.90 | 90 |
| Kodak Edge5 | F | 1.30 | 1.0 | 90.84 | −0.3 | −0.9 | 0.89 | 253 |
| Kodak Edge5 | G | 0.70 | 0.5 | 90.65 | −0.3 | −0.7 | 0.72 | 256 |
| Kodak Edge5 | G | 1.40 | 1.0 | 90.78 | −0.2 | −1.0 | 1.02 | 259 |
| Kodak Edge5 | H | 0.70 | 0.5 | 90.81 | −0.1 | −1.7 | 1.70 | 270 |
| Kodak Edge5 | H | 1.40 | 1.0 | 90.79 | −0.3 | −1.9 | 1.92 | 262 |
| Fuji SFAVIII | none | comparative | | 90.13 | 0.2 | 2.4 | 2.41 | 85 |
| Fuji SFAVIII | B | 0.6 | 0.5 | 90.11 | 0.2 | 1.3 | 1.27 | 80 |
| Fuji SFAVIII | B | 1.20 | 1.0 | 90.15 | 0.3 | 0.5 | 0.58 | 60 |
| Fuji SFAVIII | B | 1.80 | 1.5 | 90.14 | 0.3 | −0.1 | 0.30 | 341 |

TABLE 1-continued

| Paper | Additive | g/L formulation | g/L active substance | L* | a* | b* | C | H |
|---|---|---|---|---|---|---|---|---|
| Fuji SFAVIII | A | 2.38 | 0.5 | 90.04 | 0.3 | 1.0 | 0.98 | 76 |
| Fuji SFAVIII | A | 5.76 | 1.0 | 90.22 | 0.3 | 0.6 | 0.60 | 90 |
| Fuji SFAVIII | A | 7.14 | 1.5 | 90.24 | 0.3 | 0.3 | 0.39 | 50 |
| Fuji SFAVIII | C | 0.64 | 0.5 | 90.21 | 0.3 | 0.7 | 0.76 | 67 |
| Fuji SFAVIII | C | 1.28 | 1.0 | 90.28 | 0.3 | −0.3 | 0.39 | 310 |
| Fuji SFAVIII | E | 1.64 | 0.5 | 90.17 | 0.3 | 1.3 | 1.33 | 78 |
| Fuji SFAVIII | E | 1.30 | 1.0 | 90.28 | 0.4 | 0.8 | 0.87 | 67 |
| Fuji SFAVIII | F | 0.64 | 0.5 | 90.29 | 0.3 | 1.3 | 1.33 | 78 |
| Fuji SFAVIII | F | 1.30 | 1.0 | 90.26 | 0.4 | 0.6 | 0.69 | 60 |
| Fuji SFAVIII | G | 0.70 | 0.5 | 90.17 | 0.4 | 0.7 | 0.76 | 67 |
| Fuji SFAVIII | G | 1.40 | 1.0 | 90.19 | 0.4 | 0.2 | 0.45 | 26 |
| Fuji SFAVIII | H | 0.70 | 0.5 | 90.28 | 0.3 | −0.7 | 0.72 | 284 |
| Fuji SFAVIII | H | 1.40 | 1.0 | 90.31 | 0.2 | −1.2 | 1.22 | 280 |
| Agfa Typ10 | none | comparative | | 90.10 | −0.2 | 1.7 | 1.71 | 96 |
| Agfa Typ10 | B | 0.6 | 0.5 | 90.12 | 0.0 | 0.3 | 0.30 | 90 |
| Agfa Typ10 | B | 1.20 | 1.0 | 90.13 | 0.4 | −0.7 | 0.78 | 296 |
| Agfa Typ10 | B | 1.80 | 1.5 | 90.16 | 0.3 | −1.2 | 1.24 | 285 |
| Agfa Typ10 | A | 2.38 | 0.5 | 90.06 | 0.3 | −0.1 | 0.30 | 341 |
| Agfa Typ10 | A | 5.76 | 1.0 | 90.21 | 0.2 | −0.5 | 0.54 | 292 |
| Agfa Typ10 | A | 7.14 | 1.5 | 90.03 | 0.2 | −0.8 | 0.82 | 283 |
| Agfa Typ10 | C | 0.64 | 0.5 | 90.12 | 0.1 | −0.2 | 0.22 | 295 |
| Agfa Typ10 | C | 1.28 | 1.0 | 90.30 | 0.4 | −1.1 | 1.15 | 287 |
| Agfa Typ10 | D | 3.76 | 0.5 | 90.11 | 0.1 | 1.2 | 1.20 | 90 |
| Agfa Typ10 | D | 7.52 | 1.0 | 90.22 | 0.1 | 1.0 | 1.00 | 90 |
| Agfa Typ10 | E | 1.64 | 0.5 | 90.16 | 0.2 | −0.1 | 0.21 | 332 |
| Agfa Typ10 | E | 1.30 | 1.0 | 90.24 | 0.2 | −0.5 | 0.54 | 292 |
| Agfa Typ10 | F | 0.64 | 0.5 | 90.21 | 0.2 | 0.2 | 0.21 | 72 |
| Agfa Typ10 | F | 1.30 | 1.0 | 90.31 | 0.2 | −0.5 | 0.54 | 292 |
| Agfa Typ10 | G | 0.70 | 0.5 | 90.24 | 0.2 | −0.1 | 0.21 | 332 |
| Agfa Typ10 | G | 1.40 | 1.0 | 90.29 | 0.3 | −1.0 | 1.04 | 286 |

It is seen from Table 1, that stain removing agents of the invention are efficient in removing the stain of colour photographic materials (chrominance). They show also a strong effect in diminishing the yellow stain.

Example 2

(Blends)

The efficiency of the new process making use of blends of compounds of formula (I) and compounds of formula (II) was tested by developing commercially available photographic colour papers in a model processing solution. For this purpose, samples were cut out of each of two commercial papers: Fuji SFA VIII and Kodak Edge 5. One half of each sample was exposed through filter combination determined to give equal density of the magenta, cyan and yellow dyes. The other half was hidden, to give white portion.

Exposure Conditions

| | Cibachrome filters | | | | | |
|---|---|---|---|---|---|---|
| Paper | Y | M | C | UV | Wratten 96 | Time |
| Fuji SFAVIII | 130 | 120 | — | 2C | 2.2 | 7" |
| Kodak Edge5 | 120 | 120 | — | 2C | 2.3 | 7" |

A working processing solution was prepared by adding following components in a 1 L cylinder, under gentle mixing:

| Component | Amount |
|---|---|
| Water | 800 ml |
| Triethanolamine 100% | 11.0 ml |
| Potassium sulfite, water free | 0.30 g |
| N,N diethyl-hydroxylamine | 5.1 ml |
| Lithium sulfate, water free | 2.7 g |
| Diethylenetriamine, pentaacetic acid | 320 mg |
| Potassium chloride, water free | 1.8 g |
| Potassium bromide, water free | 0.020 g |
| N-Ethyl,N-(bety-methanesulfon-amidoethyl), 3-methyl-4-amino-aniline sulfate | 4.85 g |
| Potassium carbonate, water free | 25.0 g |
| Optical brightener | see table 2 |
| Water | fill up to 1 L |

As bleachfix, the commercially available Agfa P94 solution was used.

Samples (one of each paper) were developed together with a Jobo 2000 machine, using following program:

| | |
|---|---|
| prewash | 4 min |
| prewash | 30 sec |
| developer | 45 sec |
| bleach-fix | 45 sec |
| wash | 3 min 30 sec |

The CIE-L*a*b* values were measured with a Datacolor Elrepho 2000 densitometer in the D65/15° mode. The instrument was calibrated with a black standard and with $BaSO_4$ as white standard. The UV proportion of the lamp was also calibrated using a textile scale.

Table 2 shows CIE-L*a*b* measurements of the white of papers processed with optical brighteners of present invention. The polar coordinates C (Chrominance) and H (Hue) are also given.

The structures of compounds 1 and 2 can be found in Example 3.

TABLE 3

| Compound | Solubility of the active substance in $K_2CO_3$ 0.2 M solution | |
|---|---|---|
| B | 25.6% | I |
| C | 39.0% | I |
| E | 38.5% | I |
| F | 38.5% | I |
| G | 32.0% | I |
| H | 32.0% | I |
| Comp-1 | 3.4% | C |
| Comp-2 | 13.3% | C |
| Comp-3 | 6.6% | C |

I: compound(s) of the invention
C: comparison

It is seen from Table 3, that the stain removing agents of the invention show a good performance regarding solubility in solutions of the pH of a developer.

TABLE 2

| Paper | Additive of formula I | g/L active substance of formula I | Additive of formula II | g/L active substance of formula II | L* | a* | b* | C | H |
|---|---|---|---|---|---|---|---|---|---|
| Kodak Edge5 | none | — | none | comparison | 91.3 | 0.3 | 4.4 | 4.4 | 87 |
| Kodak Edge5 | B | 0.40 | Comp-2 | 0.10 | 91.7 | 0.3 | 2.4 | 2.4 | 82 |
| Kodak Edge5 | B | 0.80 | Comp-2 | 0.20 | 91.6 | 0.3 | 1.7 | 1.7 | 81 |
| Kodak Edge5 | B | 1.20 | Comp-2 | 0.30 | 91.7 | 0.2 | 0.8 | 0.8 | 74 |
| Kodak Edge5 | B | 0.30 | Comp-2 | 0.20 | 91.6 | 0.2 | 1.8 | 1.8 | 83 |
| Kodak Edge5 | B | 0.60 | Comp-2 | 0.40 | 92.0 | 0.2 | 0.6 | 0.7 | 73 |
| Kodak Edge5 | B | 0.25 | Comp-2 | 0.25 | 91.9 | 0.3 | 1.5 | 1.5 | 80 |
| Kodak Edge5 | B | 0.50 | Comp-2 | 0.50 | 92.0 | 0.2 | 0.2 | 0.3 | 53 |
| Kodak Edge5 | B | 0.25 | Comp-1 | 0.25 | 91.6 | 0.0 | 1.7 | 1.7 | 89 |
| Kodak Edge5 | B | 0.50 | Comp-1 | 0.50 | 91.7 | −0.1 | 0.7 | 0.7 | 274 |
| Kodak Edge5 | B | 0.17 | Comp-1 | 0.33 | 91.6 | 0.2 | 2.2 | 2.2 | 86 |
| Kodak Edge5 | B | 0.34 | Comp-1 | 0.66 | 91.7 | 0.1 | 1.2 | 1.2 | 84 |
| Fuji SFAVIII | none | — | none | comparison | 90.3 | 0.4 | 3.1 | 3.1 | 82 |
| Fuji SFAVIII | B | 0.40 | Comp-2 | 0.10 | 90.6 | 0.3 | 1.1 | 1.1 | 73 |
| Fuji SFAVIII | B | 0.80 | Comp-2 | 0.20 | 90.7 | 0.2 | 0.6 | 0.6 | 70 |
| Fuji SFAVIII | B | 1.20 | Comp-2 | 0.30 | 90.5 | 0.2 | −0.2 | 0.3 | 315 |
| Fuji SFAVIII | B | 0.30 | Comp-2 | 0.20 | 90.6 | 0.1 | 0.4 | 0.5 | 71 |
| Fuji SFAVIII | B | 0.60 | Comp-2 | 0.40 | 90.7 | 0.3 | −0.8 | 0.9 | 293 |
| Fuji SFAVIII | B | 0.25 | Comp-2 | 0.25 | 90.7 | 0.2 | 0.0 | 0.2 | 5 |
| Fuji SFAVIII | B | 0.50 | Comp-2 | 0.50 | 90.9 | 0.2 | −0.9 | 0.9 | 286 |
| Fuji SFAVIII | B | 0.25 | Comp-1 | 0.25 | 90.3 | 0.1 | 0.6 | 0.6 | 82 |
| Fuji SFAVIII | B | 0.50 | Comp-1 | 0.50 | 90.6 | 0.1 | −0.5 | 0.5 | 286 |
| Fuji SFAVIII | B | 0.17 | Comp-1 | 0.33 | 90.3 | 0.1 | 0.8 | 0.8 | 84 |
| Fuji SFAVIII | B | 0.34 | Comp-1 | 0.66 | 90.5 | 0.1 | 0.1 | 0.1 | 31 |

It is seen from Table 2, that stain removing agents of the invention blended with stain removing agents of formula (II) are efficient in removing the stain of colour photographic materials (chrominance). They show also a strong effect in diminishing the yellow stain.

Example 3

Solubility

The solubility of stain removing agent of the invention in solutions of the pH of a developer solution was determined by measuring the amount of a 0.2M $K_2CO_3$ solution required to fully dissolve a given quantity of the product at room temperature.

Compounds 1 to 3
| Compound | Active substance | Formulation |
|---|---|---|
| Comp-1 | 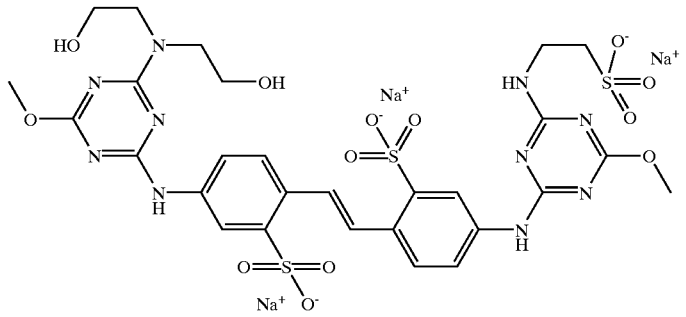 (main component) | 81% active substance<br>17% water<br>2% NaCl<br>solid |
| Comp-2 | 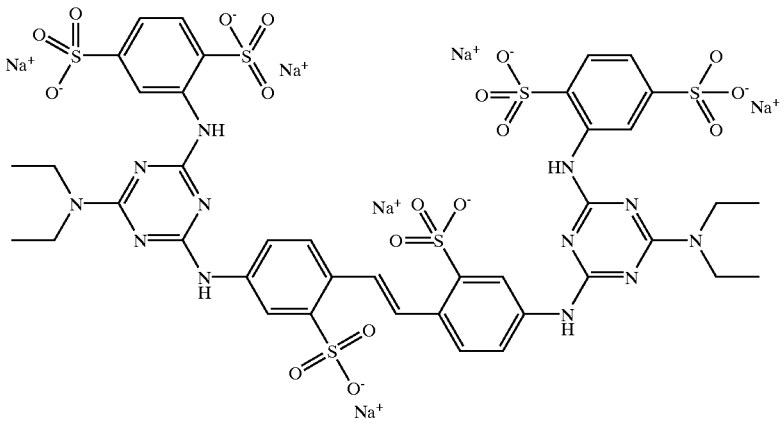 | 76% active substance<br>11% water<br>13% NaCl<br>solid |
| Comp-3 | 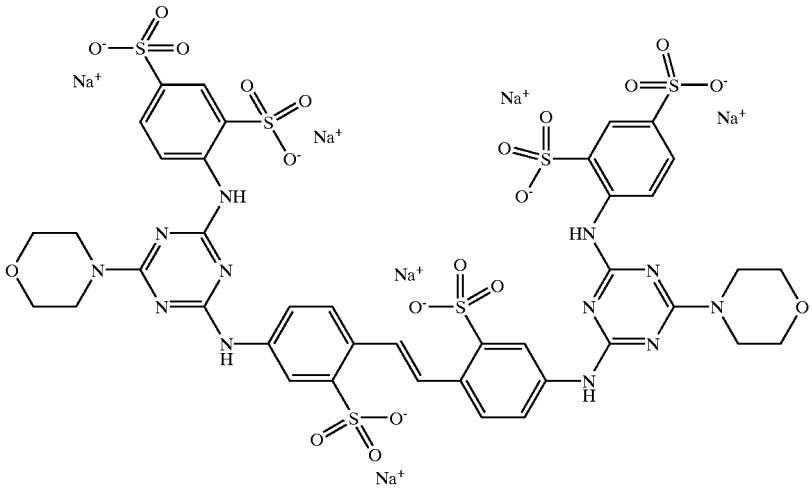 | 78% active substance<br>18% water<br>4% NaCl<br>solid |

What is claimed is:

1. A process for removing stain in a photographic material which process comprises incorporation of at least one compound of the formula (I)

(I)

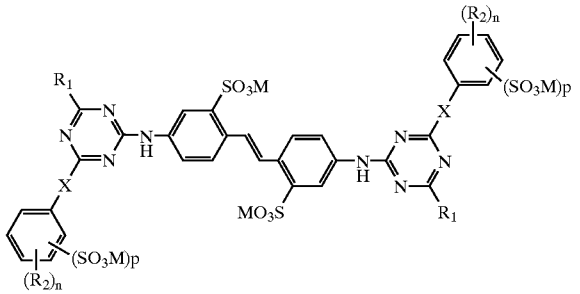

wherein

X is O or NH;

n is 1 or 2, p is 0, 1 or 2,

M is hydrogen, an alkali metal atom, ammonium or a cation formed from an amine;

each $R_1$, independently, is an aminoacid residue from which a hydrogen atom on the amino group has been removed;

each $R_2$, independently, is hydrogen, $C_1$–$C_8$alkyl, $C_1$–$C_8$alkoxy, halogen, cyano, COOR, wherein R is hydrogen or $C_1$–$C_3$alkyl, CONH—R in which R has its previous significance, $SO_2NH$—R in which R has its previous significance, NH—COR in which R has its previous significance, or $SO_3M$, wherein M has its previous significance, or, if n is 1, $R_2$ can also be CO—$R_3$ in which $R_3$ is $C_1$–$C_3$alkyl or phenyl, in that photographic material.

2. A process according to claim 1, wherein in formula (I) X is NH.

3. A process according to claim 1, wherein in formula (I) M is hydrogen, Na, K, Ca, Mg, ammonium, mono-, di-, tri- or tetra-$C_1$–$C_4$alkylammonium, mono-, di- or tri-$C_1$–$C_4$hydroxyalkylammonium or ammonium that is di- or tri-substituted with a mixture of $C_1$–$C_4$alkyl and $C_1$–$C_4$hydroxyalkyl groups.

4. A process according to claim 3, wherein in formula (I) each M is Na.

5. A process according to claim 1, wherein in formula (I)

n is 1 and $R_2$ is hydrogen, methyl, chlorine, cyano, COOH, COO-methyl, $CONH_2$, CONH-methyl, $SO_2NH_2$, $SO_2NH$-methyl or NH—COmethyl.

6. A process according to claim 1, wherein in formula (I) each of the aminoacid residues $R_1$ is the same and each has the formula —NH—CH($CO_2H$)—$R_3$ in which $R_3$ is hydrogen or a group having the formula —$CHR_4R_5$ in which $R_4$ and $R_5$, independently, are hydrogen or $C_1$–$C_4$alkyl optionally substituted by one or two substituents selected from hydroxy, thio, methylthio, amino, carboxy, sulfo, phenyl, 4-hydroxyphenyl, 3,5-diiodo-4-hydroxyphenyl, β-indolyl, β-imidazolyl and NH=C($NH_2$)NH—.

7. A process according to claim 6, wherein in formula (I) the aminoacid from which the aminoacid residues $R_1$ are derived is glycine, alanine, sarcosine, serine, cysteine, phenylalanine, tyrosine (4-hydroxyphenytalanine), diiodotyrosine, tryptophan (β-indolylalanine), histidine (β-imidazolylalanine), α-aminobutyric acid, methionine, valine (α-aminoisovaleric acid), norvaline, leucine (α-aminoisocaproic acid), isoleucine (α-amino-β-methylvaleric acid), norleucine (α-amino-n-caproic acid), arginine, ornithine (α,δdiaminovaleric acid), lysine (α,ε-diaminocaproic acid), aspartic acid (aminosuccinic acid), glutamic acid (α-aminoglutaric acid), threonine, hydroxyglutamic acid or taurine, or a mixture or an optical isomer thereof.

8. A process according to claim 7, wherein in formula (I) the aminoacid from which the aminoacid residues $R_1$ are derived is sarcosine, taurine, glutaric acid or aspartic acid.

9. A process according to claim 1, wherein in formula (I) the aminoacid from which each aminoacid residue $R_1$ is derived is iminodiacetic acid.

10. A process according to claim 1 in which n is 1 and $R_2$ is CO—$R_3$ in which $R_3$ is $C_1$–$C_3$alkyl or phenyl.

11. A process according to claim 10 in which $R_3$ is methyl.

12. A process according to claim 1, wherein in formula (I)

X is NH;

n is 1, p is 0, $R_1$ is derived from glutaric acid or iminodiacetic acid, $R_2$ is hydrogen or $SO_3M$, and M is sodium.

13. A process for removing stain in a photographic material which process comprises incorporation of at least one compound of the formula (I) according to claim 1 in combination with another optical brightener of the formula (II)

(II)

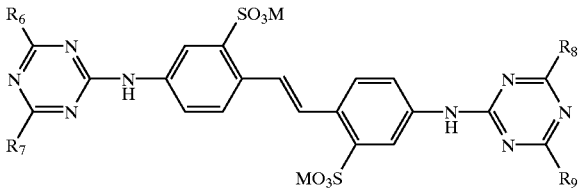

wherein $R_6$ to $R_9$ may be the same different and each represents a hydroxyl group, an alkoxy group having 1 to 4 carbon atoms such as a methoxy, ethoxy or methoxyethoxy group, an amino group, an alkylamino group having 1 to 6 carbon atoms such as methylamino, ethylamino, propylamino, dimethylamino, cyclohexyamino, di-(beta-hydroxyethyl)-amino, beta-sulfoethylamino, N-(beta-sulfoethyl)-N-methylamino or beta-carboxylethylamino group, an aryloxy group such as a phenoxy or p-sulfophenyl group, an arylamino group such as an anilio, o-, m- or p-sulfoanilino, o-, m- or p-chloranilino, o-, m- or p-toluidino, o-, m- or p-carboxyanilino, o-, m- or p-anisidino or o-, m- or p-hydroxyanilino group, or a halogen atom and M is a monovalent cation such as a sodium or potassium ion.

14. A process according to claim 1 wherein another processing additive is additionally incorporated.

15. A process according to claim 1 in which the compound of formula (I) is present in an amount of 0.01 g to 1 g per square meter of the photographic paper.

* * * * *